United States Patent [19]

Smilovici

[11] Patent Number: 5,014,524

[45] Date of Patent: May 14, 1991

[54] FLAT BED KNITTING MACHINE HAVING PLURAL CARRIAGES

[76] Inventor: Adrian Smilovici, 205 W. 57th St., #3DB, New York, N.Y. 10019

[21] Appl. No.: 397,515

[22] Filed: Aug. 23, 1989

[51] Int. Cl.[5] ..... D04B 15/99

[52] U.S. Cl. ..... 66/64; 66/60 H

[58] Field of Search ..... 66/60, 60 H, 62, 64, 66/69

[56] References Cited

U.S. PATENT DOCUMENTS

| | | | |
|---|---|---|---|
| 3,751,944 | 8/1973 | Krause | 66/64 |
| 3,861,174 | 1/1975 | Kunisada et al. | 66/60 |
| 3,910,071 | 10/1975 | Schieber et al. | 66/64 |
| 4,640,103 | 2/1987 | Schieber | 66/64 |
| 4,724,685 | 2/1988 | Stoll et al. | 66/64 |

FOREIGN PATENT DOCUMENTS

| | | | |
|---|---|---|---|
| 0173353 | 10/1984 | Japan | 66/60 H |
| 0050782 | 12/1984 | Japan | 66/60 H |
| 0036494 | 8/1985 | Japan | 66/60 H |
| 0054423 | 11/1985 | Japan | 66/60 H |

*Primary Examiner*—Werner H. Schroeder
*Assistant Examiner*—John J. Calvert
*Attorney, Agent, or Firm*—Fitzpatrick Cella Harper & Scinto

[57] ABSTRACT

A flat bed knitting machine having plural carriages that are independently controllable, preferably both as to movement along a needle bed and as to the knitting task performed thereby. A separate driver is provided for each of the carriages to move the carriages independently and reciprocally along the needle bed. A preferred embodiment includes a device for preventing the carriages from interfering with one another as they are moved along the needle bed.

23 Claims, 4 Drawing Sheets

FLAT BED KNITTING MACHINE HAVING PLURAL CARRIAGES

BACKGROUND

1. Field of the Invention

The present invention relates to a flat bed knitting machine with at least two carriages arranged on an elongated needle bed, the two carriages being reciprocally driven along the needle bed to produce knitted fabrics.

2. Description of the Related Art

Flat bed knitting machines generally include an elongated needle bed usually consisting of front and rear needle assemblies and a carriage which slides over the needle bed. With this arrangement, knitted fabrics can be knitted, the maximum width of which corresponds to the operative width of the needle bed. Typically, such flat bed knitting machines have a needle bed whose width is about 100 cm to 230 cm to accommodate the largest knitted fabric envisioned.

A single carriage provided on a needle bed has long been recognized as wasteful when the machine is only used to produce a knitted fabric of the maximum width. A solution that has been proposed provides two carriages on the needle bed, each carriage performing the same knitting task as the other carriage but at a separate areas of the needle bed. This permits two identical knitted fabrics to be produced, each having a maximum width of slightly less than one-half the operative width of the entire needle bed, that is, approximately 100 cm each. (The reduction from exactly one-half corresponds to the space which must be maintained between the knitted fabrics to insure that one carriage does not affect the stitches in the fabric knitted by the other carriage.)

For example, U.S. Pat. No. 4,640,103, issued to Hans Schreiber on Feb. 3, 1987, describes a double carriage flat bed knitting machine in which one carriage is selectably removable. When both carriages are present, the knitting stroke is shortened, thereby permitting two identical knitted fabrics to be produced. When only one carriage is present, the entire operative width of the needle bed is available for the production of a knitted fabric. This patent is said to provide the advantages of both a single- and a double-carriage knitting machine.

Whatever advantages might be obtained from the arrangement shown in U.S. Pat. No. 4,640,103, still only one knitted fabric, or two identical knitted fabrics, may be produced. This limits the type of knitted fabric that may be produced by such knitting machines to those fabrics producible by a single head, and makes production of certain weaves (for example, cabling and other complex stitch constructions) very difficult.

SUMMARY OF THE INVENTION

It is an object of the present invention to provide a flat bed knitting machine capable of overcoming these and other difficulties now found in the art.

It is a further object of the present invention to provide a flat bed knitting machine having a plurality of carriages arranged on a needle bed, the carriages being independently driven both as to direction and as to length of reciprocal stroke.

It is a further object of the present invention to provide a flat bed knitting machine having a plurality of carriages arranged on the needle bed, individual ones of the carriages being independently driven across the whole length or any part of the whole length of the machine in both directions using the whole length or any part of the machine without interfering or colliding with each other. The speeds at which the carriages are driven are totally independent of each other.

It is a further object of the present invention to provide a flat bed knitting machine in which a plurality of carriages arranged on a needle bed are operable to produce two or more different knitted fabrics, or are cooperable to produce a single knitted fabric in the same area of the needle bed.

These and other objects of the present invention are obtained by the provision of a flat bed knitting apparatus in which a plurality of carriages are provided on a needle bed, each of the carriages mounted for movement in a longitudinal direction of the needle bed. Plural driving means, one corresponding to each one of said plurality of carriages, are provided for the carriages, each of the driving means for reciprocally driving its corresponding carriage on the needle bed, and each of the driving means being operable independently with respect to the other driving means. A controller is provided that is operable to control the driving means and the carriages so that each carriage can execute a different knitting task. Preventing means are also provided to prevent the carriages from interfering with each other. Variable take-up means for taking the knitted fabric out of the flat bed knitting apparatus is also provided. The variable take-up means is adapted to allow the knitted fabric to be removed from the apparatus at a rate that corresponds to the rate at which it is used.

The objects of the invention are also achieved through a process of producing one or more knitted fabrics, including complex knits (such as Jacquard and Intarsia) and complex weaves (such as cabling and other stitch constructions), through the step of independently and reciprocally driving a plurality of carriages on a single needle bed. When necessary, coordination of the plurality of carriages is achieved by preventing the carriages from interfering with each other. The knitted fabric so produced is removed from the flat bed knitting machine at different rates along the needle bed, the different rates corresponding to the rate at which the fabric is produced.

This brief summary is provided so that the nature of the invention may be understood quickly. However, the invention is described in significantly more detail in the following Detailed Description of the Preferred Embodiment in conjunction with the accompanying drawings, both of which form a complete part of the specification.

DETAILED DESCRIPTION OF THE PREFERRED EMBODIMENT

Figure 1:
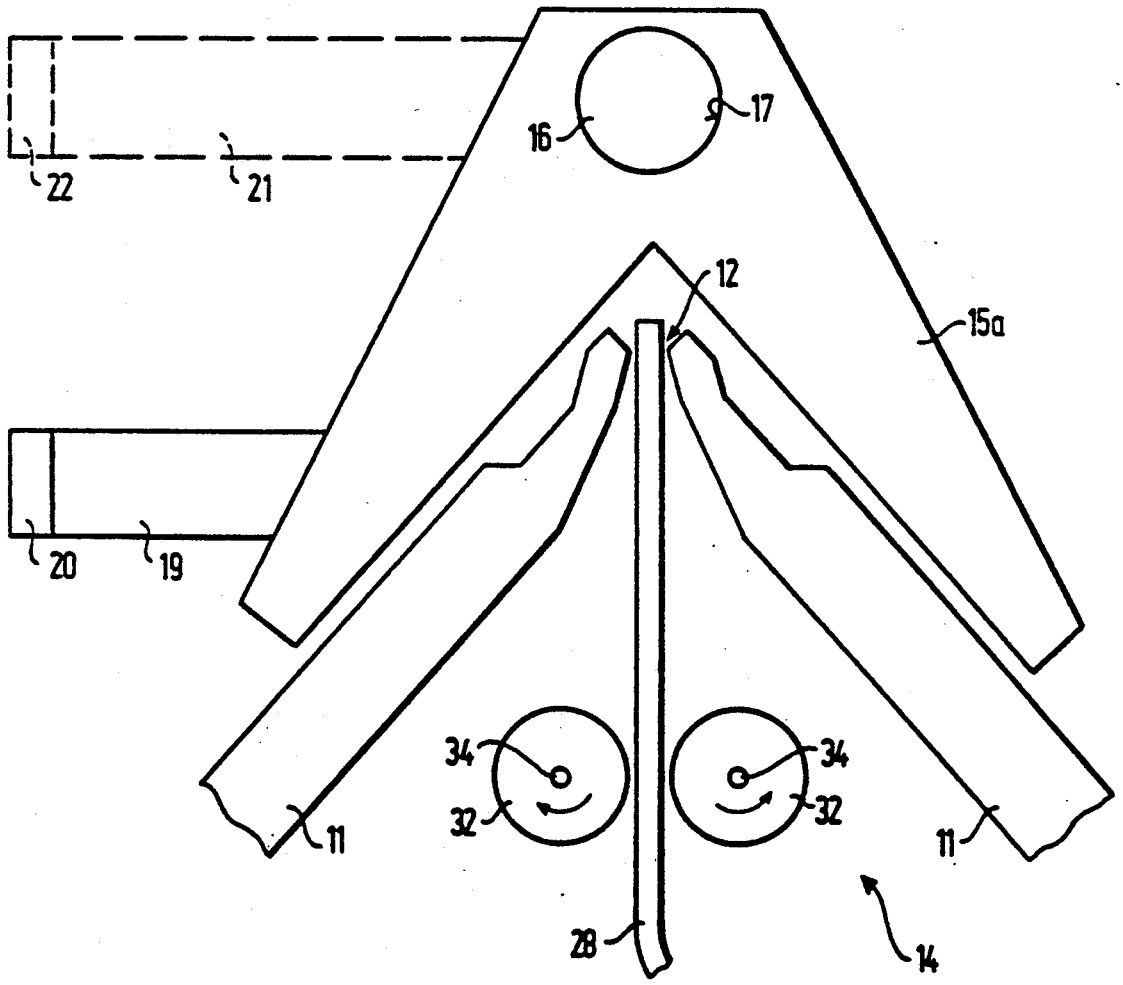
FIG. 1 is a partly schematic, cross-sectional elevational view of an apparatus according to the present invention in which the connecting member for the second carriage is shown in dotted lines.

Referring to FIG. 1, front and rear needle assemblies 11 are arranged opposite one another with gap 12 therebetween so as to form needle bed 14. As is known, the needle bed includes a large number of parallel needles lowerable in respective needle grooves of the needle bed; the lowerable needles are brought into engaging positions by selector arrangements (not shown) included in carriages 15*a* and 15*b*.

Carriages 15*a* and 15*b* (see FIG. 2) are mounted for movement on the needle bed 14 by means of a support rod 16 accepted in hole 17 at the top of each of the carriages. The support rod 16 extends across the operative width of needle bed 14, and allows the carriages to be moved as desired.

Each of the carriages 15*a* and 15*b* may be provided with a plurality of knitting systems to permit more or less complicated manipulation of the needles in needle bed 14, as desired.

Various yarn feeders (not shown) are also conveniently mounted on rod 16. However, the specific manner in which yarn is provided to the carriages and the needle bed forms no part of the invention per se, and further discussion thereof will be omitted.

Referring again to FIG. 1, carriage 15*a* is provided at a lower inside extremity thereof with connecting member 19. The connecting member 19 permits attachment of carriage 15*a* to reciprocal driving means. In the present embodiment, the driving means is in the form of a toothed resilient belt 20 which, in connection with reversing drive motor 24 described herein below, permits selective adjustment of the stroke for carriage 15*a*, and permits reciprocal movement of carriage 15*a* across needle bed 14.

In a similar manner, carriage 15*b* is provided at the upper inside extremity thereof with a connecting member 21 that permits attachment of carriage 15*b* to drive means, comprising toothed resilient belt 22 and reversing drive motor 26 so as to permit selective adjustment of the stroke for carriage 15*b* and to permit reciprocal movement of carriage 15*b* across needle bed 14.

Figure 2:
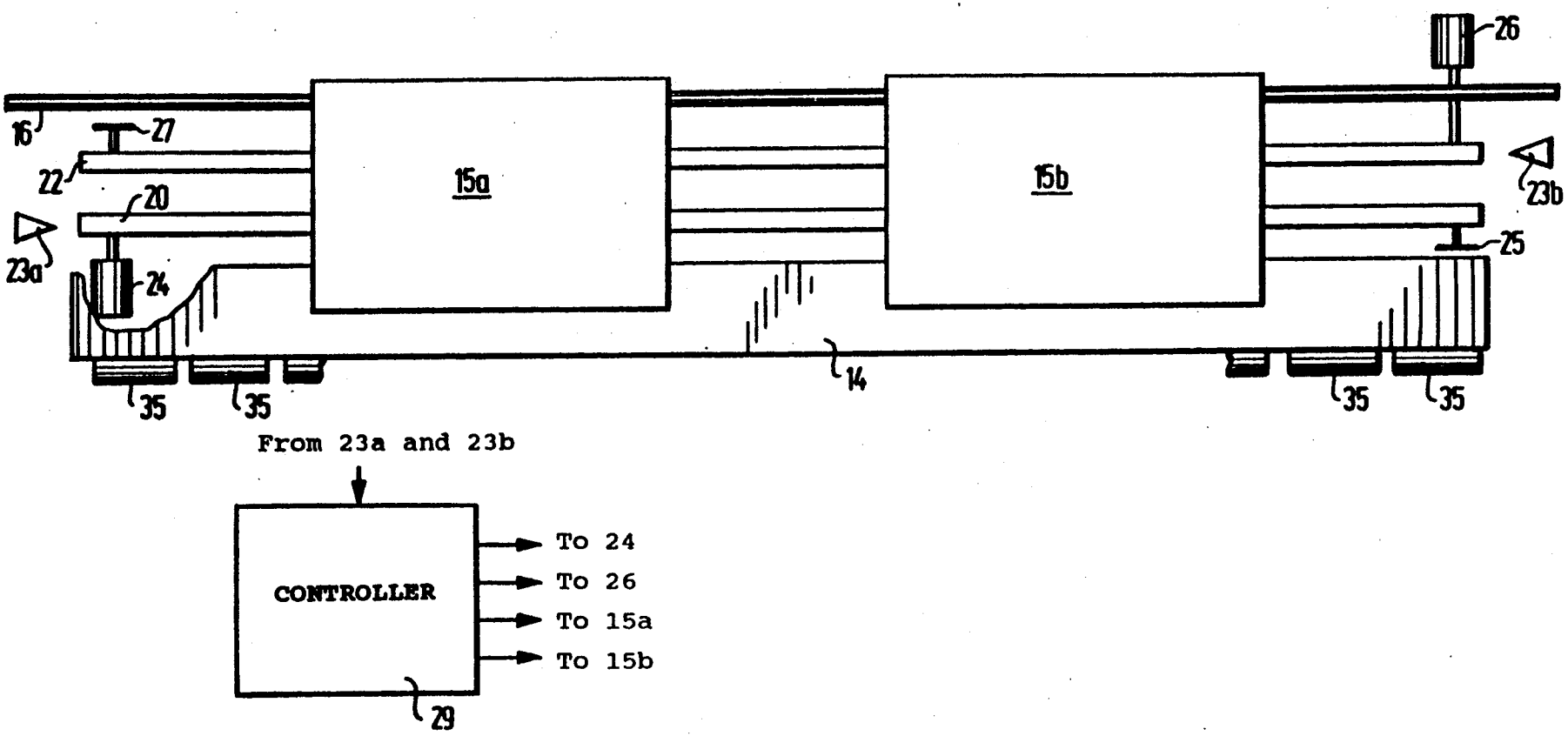
FIG. 2 is a front elevational view, partly cut away, of the apparatus of FIG. 1.
Figure 3:
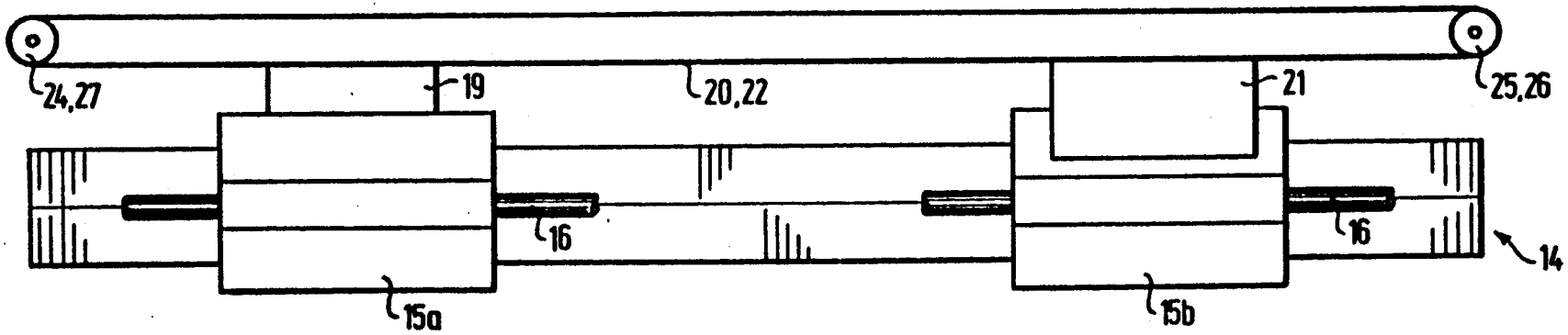
FIG. 3 is a top plan view of the apparatus of FIG. 1.
Figure 4:
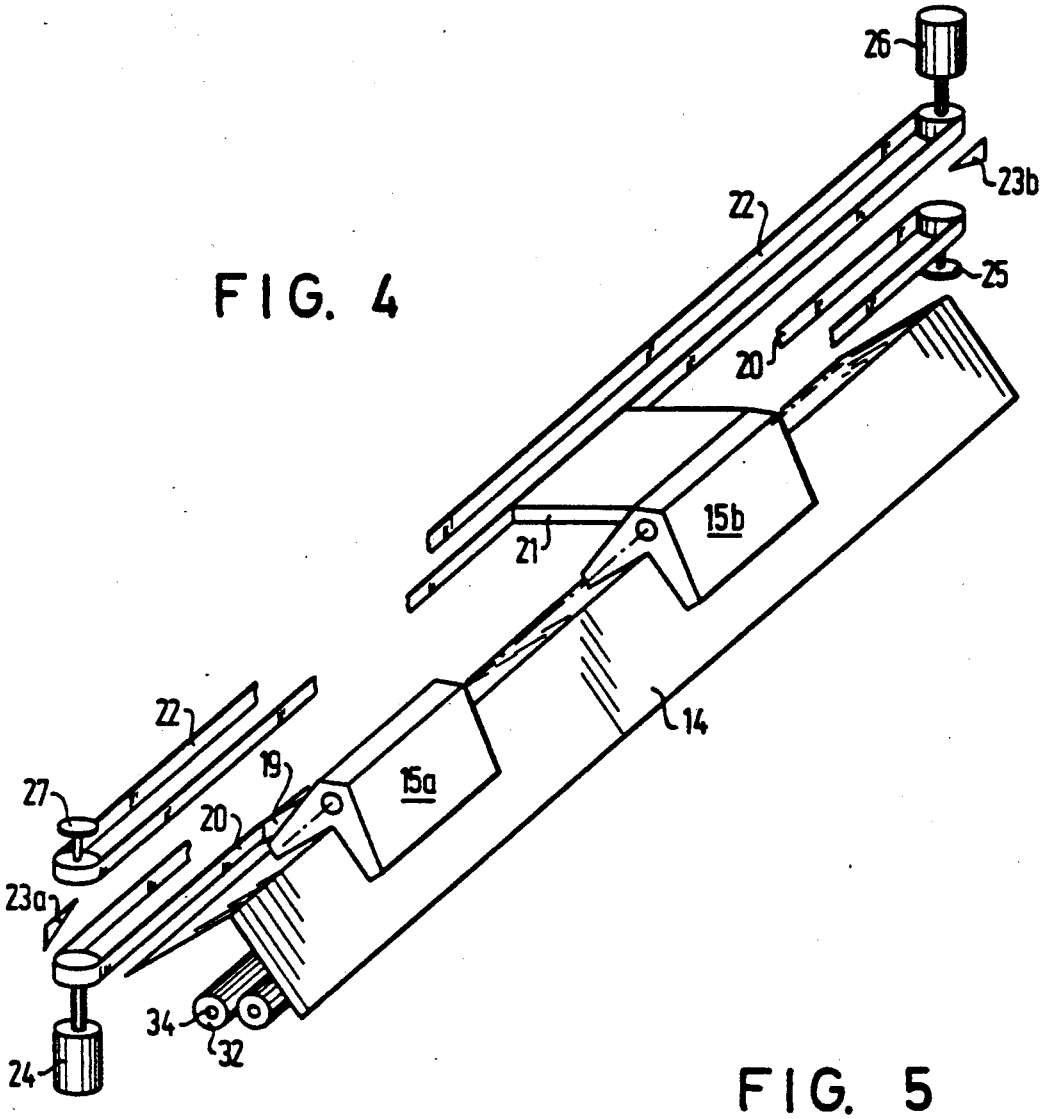
FIG. 4 is a schematic, perspective view of the apparatus of FIG. 1.

As shown in FIG. 2, toothed belt 20 is provided at its left-most extremity with reversing drive motor 24, and at its right-most extremity with a pivot point 25. Adjacent drive motor 24 is a sensor 23*a* that defines a home position for carriage 15*a* and generates a signal when carriage 15*a* is in its home position. In like manner, toothed belt 22 is provided at its right-most extremity with reversible drive motor 26, and at its left-most extremity with pivot-point 27. Adjacent drive motor 26 is a sensor 23*b* that defines a home position for carriage 15*b* and generates a signal when carriage 15*b* is in its home position. The various belts, drive motors, pivot points and sensors are provided in a mirror image arrangement so as to reduce the spacing between belts 20 and 22.

In the present embodiment, drive motors 24 and 26 are pulse motors. As known, such motors respond with a predetermined rotational angle for every pulse applied thereto. Thus, through the provision of separate carriages 15*a* and 15*b*, as well as their associated drive belts and reversible drive motors, each of the carriages is provided with fully independent reciprocal drive over the length of needle bed 14, and each carriage may be moved at mutually different speeds.

Each of motors 24 and 26, as well as carriages 15*a* and 15*b*, are operated under the control of a controller, preferably a digital microcomputer. The controller is shown schematically at 29. Control over one carriage to direct its knitting task and over its associated drive to move the carriage appropriately is conventional and a detailed description will be omitted. In the present invention, however, controller 29 is provided with two such controls, one for each of carriages 15*a* and 15*b* and their associated drive means. As such, controller 29 is capable of independently controlling carriages 15*a* and 15*b* with respect to their relative knitting tasks, and is capable of independently controlling the drive means associated with carriages 15*a* and 15*b* so as to move the carriages independently and at different speeds, as appropriate.

In addition to individual control over the drive motors and the carriages, the controller permits coordination between the operation of carriages 15*a* and 15*b*. That is, since the full bed is available to both carriages 15*a* and 15*b*, means must be provided to prevent the carriages from interfering with each other. Such means permit both carriages to operate simultaneously to produce complex patterns, weaves or shapes in a single knitted fabric, or permit the carriages collectively to use the entire operative width of the needle bed 14 to produce a plurality of knitted fabrics. By preventing carriages 15*a* and 15*b* from interfering with each other, the knitted fabric being produced by carriage 15*a* can be closely placed to the knitted fabric being produced by carriage 15*b*, since there is no need to be concerned about collision of the carriages.

In the present embodiment of the invention, the means for preventing interference between the heads is provided by a position monitor within controller 29 for each of the carriages. The position monitor functions in accordance with the control exerted over drive motors 24 and 26 to produce a signal indicative of the position of each of carriages 15*a* and 15*b*. More specifically, by counting the pulses, both positive and negative, that are applied to drive motors 24 and 26, a signal may be formed for each motor that indicates the relative displacement of each carriage from its home position, as determined by signals from sensor 23*a* and 23*b*.

By properly considering the width of each of carriages 15*a* and 15*b*, controller 29 can exert control over drive motors 24 and 26 in such a manner that carriages 15*a* and 15*b* will not interfere with each other. For example, by assigning carriage 15*a* a higher priority for control than that for carriage 15*b*, the movement of carriage 15*b* can be subordinated to that of carriage 15*a*. Thus, if the carriages are being moved toward each other, the position monitor will allow controller 29 to anticipate that the carriages will interfere with each other, and temporarily stop movement of carriage 15*b* until carriage 15*a* has completed its movement and is at a position where it will not interfere with further movement of carriage 15*b*.

Other means for preventing interference of the carriages are also possible. For example, if it is not important to utilize the entire useful area of needle bed 14, mechanical stops may be provided at appropriate positions on the needle bed to prevent the carriages from moving beyond predetermined boundaries.

As a further example of a means for preventing, an area detector actuated by movement of the carriages may be placed at potentially interfering areas. This detector would define a "hot zone" which, once entered by one of the carriages, would signal to controller 29 that the other carriage should be kept clear of the "hot zone".

Figure 5:
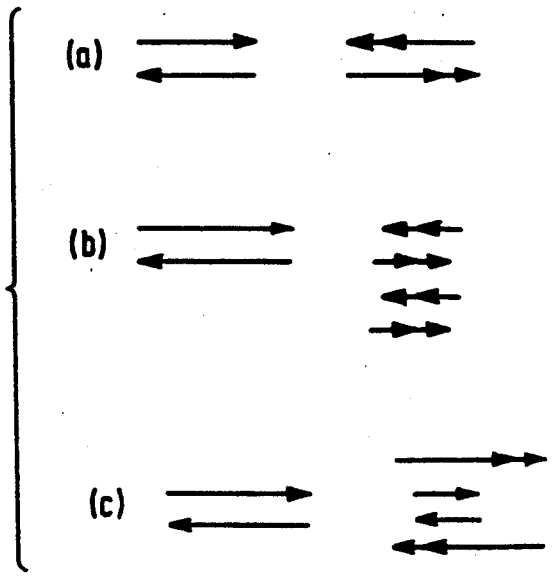
FIG. 5, comprising FIGS. 5*a, b* and *c*, is a diagram for explaining some of the possibilities for carriage movement in an apparatus according to the invention.

FIG. 5 is a diagrammatic representation of the versatility of an apparatus according to the present invention. In FIG. 5, single headed arrows depict movement of carriage 15*a*, while double headed arrows depict movement of carriage 15*b*. As shown, for example, in FIG. 5*a*, carriages 15*a* and 15*b* can be moved in opposite directions relative to each other while executing different or the same tasks. If the widths of both knitted fabrics are the same, the carriages will remain more-or-less in coordination with each other.

As shown in FIG. 5*b*, however, when knitted fabrics of different widths are produced, carriage 15*b* can move to-and-fro on the needle bed much more rapidly than carriage 15*a*. Operation in this manner clearly allows more efficient production from the knitting machine.

Finally, in FIG. 5*c*, carriage 15*a* can be utilized in cooperation with carriage 15*b* to produce complex patterns, weaves or shapes in the knitted fabric, such as Jacquard, Intarsia, cabling, etc. Thus, as shown in FIG. 5*c*, when carriage 15*b* is off to the right and not in a position to interfere with carriage 15*a*, carriage 15*a* may be brought over to the complex knitted fabric and perform a knitting operation there. As it is moved away from the complex knitted fabric, carriage 15*a* is no longer in a position to interfere with carriage 15*b*, and carriage 15*b* may thereby be brought to complete the pattern, weave or shape. Meanwhile, as carriage 15*a* is away from the complex pattern, it may be used to knit a more simple pattern in another area of the needle bed 14.

As will be evident from the foregoing description, the great versatility of an apparatus according to the present invention will yield knitted fabrics from the flat bed knitting machine at vastly different rates. It is therefore necessary to provide take-up means that extend across the length of needle bed 14 and that take-up knitted fabric at a rate that is equal to the rate at which the knitted fabric is produced.

A suitable form for such variable take-up means is shown in FIG. 1. As fabric 28 is produced from gap 12, it is received between two counter-rotating rollers 32. The rollers 32 are loosely and frictionally coupled to shaft 34 which provides the rotating drive force for the rollers. Because there is no rigid attachment between the rollers 32 and the drive shaft 34, the rollers 32 slip with respect to rotation of drive shaft 34, to provide a suitable tension for fabric 28 as it is produced by machine, and to allow the fabric to be taken up in an "on-demand" basis.

As further shown in FIG. 2, the take-up mechanism is segmented into short segments 35 along the length of needle bed 14. Thus, the take-up mechanism comprises a plurality of short segments 35 of rollers 32. Each segment operates independently of the other segment since each segment is slip fit with respect to shaft 34. Thus, a variable take-up mechanism is provided across the length of needle bed 14.

The above description of the preferred embodiment, and indeed the best embodiment known to me, has been provided so that a detailed understanding of the present invention may be obtained. However, modifications of the embodiment that do not depart from the scope of the appended claims should be evident to those skilled in the art. For example, the independent drive means for each of the plurality of carriages need not be arranged in a mirror-image fashion, as described above. Instead, one carriage can expediently be provided with a drive means above needle bed 14, while the other can be driven from below the needle bed 14. Similarly, while a toothed belt driven by reversible drive motors has been shown as the drive means for the carriages, suitable replacements, for example a self-contained drive motor within the carriage driving a gear that bears against a fixed gear, will readily be appreciated by those skilled in the art.

Similarly, other modifications of the invention will be apparent to those skilled in the art, and the embodiment described above should not be considered as limiting but only illustrative. Instead, the scope of the invention should be determined solely with reference to the claims attached hereto.

I claim:

1. A flat bed knitting apparatus comprising a needle bed and a plurality of carriages, each of said carriages being mounted for independent movement on the needle bed, said flat bed knitting apparatus further comprising a controller for controlling movement of said plurality of carriages, said controller including means for preventing said carriages from interfering with one another.

2. Apparatus according to claim 1, wherein each said carriage is operable to perform independently controllable knitting tasks.

3. Apparatus according to claim 1, further comprising plural driving means, one provided for each of said plurality of carriages, each of said driving means for independently driving its associated carriage along the needle bed, and each of said driving means being operable in accordance with a position of a carriage associated with another driving means.

4. Apparatus according to claim 1, wherein said means for preventing is selected from the group consisting of a position monitor, a mechanical stop and an area detector.

5. Apparatus according to claim 1 or 3, wherein each said carriage is drivable at different speeds.

6. A flat bed knitting apparatus comprising:

a needle bed;

a plurality of carriages, each mounted for movement on the needle bed;

plural driving means, one provided for each of said plurality of carriages, each of said driving means for reciprocally driving its associated carriage on the needle bed, and each of said driving means being operable independently relative to other driving means; and a controller operable to control said plurality of driving means to drive said plurality of carriages at mutually different speeds.

7. Apparatus according to claim 6, wherein said controller is operable to control said plurality of driving means and said plurality of carriages so that each carriage executes a different knitting task.

8. Apparatus according to claim 7, wherein said controller includes preventing means for preventing said plurality of carriages from interfering with each other.

9. Apparatus according to claim 8, wherein said preventing means includes a position monitor to allow said controller to coordinate the positions of the carriages.

10. Apparatus according to claim 6, further comprising preventing means for preventing said plurality of carriages from interfering with each other.

11. Apparatus according to claim 10, wherein said preventing means comprises a stop that defines an area of said needle bed that is inaccessible to one of said plurality of carriages.

12. Apparatus according to claim 10, wherein said preventing means comprises a detector for detecting when one of said carriages enters a predefined area.

13. A flat bed knitting apparatus comprising:

a needle bed;

a plurality of carriages, each mounted for movement on the needle bed;

plural driving means, one provided for each of said plurality of carriages, each of said driving means for reciprocally driving its associated carriage on the needle bed, and each of said driving means being operable independently relative to other driving means; and variable take-up means extending proximate said needle bed.

14. A flat bed knitting apparatus comprising:

a needle bed;

a plurality of carriages, each mounted for movement on the needle bed and each adapted to perform predetermined knitting tasks;

plural driving means, one provided for each of said plurality of carriages, each of said driving means for reciprocally driving its associated carriage on the needle bed, and each of said driving means being operable independently relative to other driving means; and preventing means for preventing said plurality of carriages from interfering with each other.

15. Apparatus according to claim 14, further comprising a controller operable to control said plurality of driving mean to drive said plurality of carriages at mutually different speeds.

16. Apparatus according to claim 14, further comprising a controller operable to control said driving means and operable to provide an input signal to said carriages representing the predetermined knitting task.

17. Apparatus according to claim 16, wherein said preventing means is comprised by said controller, and said preventing means include a position monitor to allow said controller to coordinate the positions of said carriages.

18. Apparatus according to claim 14, wherein said preventing means includes a stop that defines an area of said needle bed that is inaccessible to one of said carriages.

19. Apparatus according to claim 14, wherein said preventing means includes a detector for detecting when one of said carriages is in a predetermined area of said needle bed.

20. Apparatus according to claim 14, further comprising variable take-up means for removing knitted fabric from said apparatus.

21. A process for producing knitted fabrics from a single flat bed knitting apparatus comprising the step of independently driving a plurality of carriages on a needle bed and the step of driving the plurality of carriages at mutually different speeds.

22. A process according to claim 21, further comprising the step of preventing said plurality of carriages from interfering with one another.

23. A process according to claim 21 or 22, further comprising the step of taking up the knitted fabric from the flat bed knitting apparatus at different rates along said needle bed, the rate being appropriate to the rate at which the knitted fabric is produced.

* * * * *